US007125291B2

(12) United States Patent
Aihara

(10) Patent No.: US 7,125,291 B2
(45) Date of Patent: Oct. 24, 2006

(54) CONNECTOR WITH RETAINER

(75) Inventor: Tetsuya Aihara, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/242,164

(22) Filed: Oct. 3, 2005

(65) Prior Publication Data

US 2006/0073739 A1 Apr. 6, 2006

(30) Foreign Application Priority Data

Oct. 1, 2004 (JP) ..... 2004-290192

(51) Int. Cl.
*H01R 13/514* (2006.01)

(52) U.S. Cl. ..... 439/752

(58) Field of Classification Search ..... 439/752, 439/746, 747, 748, 749, 595, 744, 745
See application file for complete search history.

(56) References Cited

U.S. PATENT DOCUMENTS

2001/0003689 A1* 6/2001 Kim ..... 439/752
2001/0027067 A1* 10/2001 Kojima et al. ..... 439/752
2001/0051467 A1* 12/2001 Kubo ..... 439/752
2002/0193012 A1* 12/2002 Mase et al. ..... 439/752
2002/0193013 A1* 12/2002 Mase et al. ..... 439/752
2003/0148669 A1* 8/2003 Ishikawa et al. ..... 439/752
2003/0176114 A1* 9/2003 Nankou et al. ..... 439/752

FOREIGN PATENT DOCUMENTS

JP 2002-75508 3/2002

* cited by examiner

*Primary Examiner*—Tulsidas C. Patel
*Assistant Examiner*—Vladimir Imas
(74) *Attorney, Agent, or Firm*—Gerald E. Hespos; Anthony J. Casella

(57) ABSTRACT

Receiving portions (26, 27) for partial locking and full locking are formed on walls of a retainer mount hole (24) in a housing (10). The receiving portions (27) for full locking are before the receiving portions (26) for partial locking with respect to an inserting direction of a retainer (30). Resiliently deformable holding arms (35A, 35B) for partial locking and full locking are cantilevered on the retainer (30), and locking sections (41, 42) resiliently engageable with the corresponding receiving portions (26, 27) are formed at the free ends of the holding arms (35A, 35B). The holding arms (35A) for full locking extend in the inserting direction of the retainer (30) from their supported ends to their free ends, whereas the holding arms (35B) for partial locking extend in a direction opposite from the inserting direction of the retainer (30) from their supported ends to their free ends.

11 Claims, 12 Drawing Sheets

CONNECTOR WITH RETAINER

BACKGROUND OF THE INVENTION

1. Field of the Invention

The invention relates to a connector provided with a retainer.

2. Description of the Related Art

Japanese Unexamined Patent Publication No. 2002-75508 and FIG. 14 herein disclose a connector with a retainer. With reference to FIG. 14, the connector has a housing 1 and a retainer 2 is inserted into a retainer insertion opening 3 formed in one side surface of the housing 1. Terminal fittings (not shown) are accommodated in the housing 1 and are retained by the retainer 2. A partial locking projection 4 projects in from a right surface 3A of an inner wall surfaces of the retainer insertion opening 3, and a full locking projection 5 projects in from a left side surface 3B. The full locking projection 5 is at a position higher than the partial locking position 4. The retainer 2 has a base 6 and resiliently deformable holding arms 7 project up from each of the opposite widthwise ends of the base 6. A partial locking portion 8 is formed at the upper end of the right holding arm 7A and is resiliently engageable with the partial locking projection 4 to achieve partial locking. A full locking projection 9 is formed at the upper end of the left holding arm 7B and is resiliently engageable with the full locking projection 5 to achieve full locking. The retainer 2 can be held at the partial locking position by the engagement of the partial locking projection 8 and the partial locking projection 4 and can be held at the full locking position by the engagement of the full locking projections 9 and the full locking projection 5.

The partial locking projection 4 is lower than the full locking projection 5. Thus, the projecting length of the holding arms 7A for partial locking is shorter than the projecting length of the holding arms 7B for full locking. A demand exists for smaller connectors, and both holding arms 7 of the retainer 2 must be shortened to shorten the housing 1. However, a projecting length of the holding arms 7A for partial locking may not be sufficient to ensure smooth resilient deformations.

The invention was developed in view of the above problem and an object thereof is to ensure smooth resilient deformations of holding arms.

SUMMARY OF THE INVENTION

The invention relates to a connector with a housing that has at least one cavity for receiving a terminal fitting. The housing further has a retainer mount hole for receiving a retainer. The retainer mount hole is formed in an outer wall of the housing and crosses the cavity. Receiving portions for first and second locking positions are formed in the housing on substantially facing inner wall surfaces of the retainer mount hole. The retainer is movable between a first position for permitting the insertion and withdrawal of the terminal fitting and a second position for retaining the terminal fitting in the cavity. Resiliently deformable holding arms are cantilevered on the retainer. Locking sections are formed at the free ends of the holding arms and are engageable with the corresponding receiving portions at the first and second locking positions. One of the receiving portions is arranged before the other with respect to an inserting direction of the retainer. The holding arm that is engageable with one of the receiving portion extends substantially in the inserting direction of the retainer from the supported end to the free end while the holding arm that is engageable with the other receiving portion extends substantially in a direction opposite from the inserting direction of the retainer from the supported end to the free end. Thus, as compared to a case where both holding arms extend in the inserting direction of the retainer, as in the prior art, a sufficient length can be ensured for both holding arms, and smooth deformations of both holding arms is ensured.

The locking sections preferably project towards the corresponding receiving portions. The locking section of the holding arm engageable with the one receiving portion preferably is formed with a movement guiding surface sloped to decrease the thickness towards the free end. The locking section of the holding arm engageable with the other receiving portion preferably is formed with a movement guiding surface sloped to increase the thickness towards the free end. Thus, smooth deformations of both holding arms are ensured by movements of the retainer along the movement guiding surfaces.

The locking sections of the holding arms for first and second positions preferably are in mold removal holes when the retainer is in the second position and the distal end of a holding portion is fit closely in a corresponding part of the retainer mount hole with almost no clearance.

A support arm preferably is arranged substantially parallel with the holding arms while defining deformation spaces thereto.

The holding arms and the supporting arm preferably have a substantially reversed S-shape.

The holding arms preferably are substantially point-symmetric with respect to an imaginary axis extending in a widthwise direction.

The retainer positioned in the second position preferably is substantially flush with the outer surface of the housing.

A lock preferably is provided in the cavity for doubly locking the terminal fitting in the cavity in cooperation with the retainer.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector in accordance with the invention is illustrated in FIGS. 1 to 13 and includes a wide block-shaped housing 10 made of a synthetic resin. Cavities 11 extend through the housing 10 at upper and lower stages. In this embodiment, eighteen cavities 11 are at the upper stage and twenty two cavities 11 are at the lower stage. The cavities 11 at the upper stage are offset from those at the lower stage.

A lock arm 12 is formed on the top of the housing 10. Ten of the upper stage cavities 11 are at the left side of the lock arm 12 and eight of the upper stage cavities 11 are at the right side when the housing 10 is viewed from behind. The fifth upper stage cavity 11 from right is eliminated to form a cavity eliminated portion 11X. The lower stage cavities 11 are arranged substantially along the entire width, but the fifth cavity 11 from left is eliminated to form a cavity eliminated portion 11X. The cavity eliminated portions 11X at the two stages and are substantially point symmetric with respect to an imaginary center axis of the connector housing 10.

Figure 3:
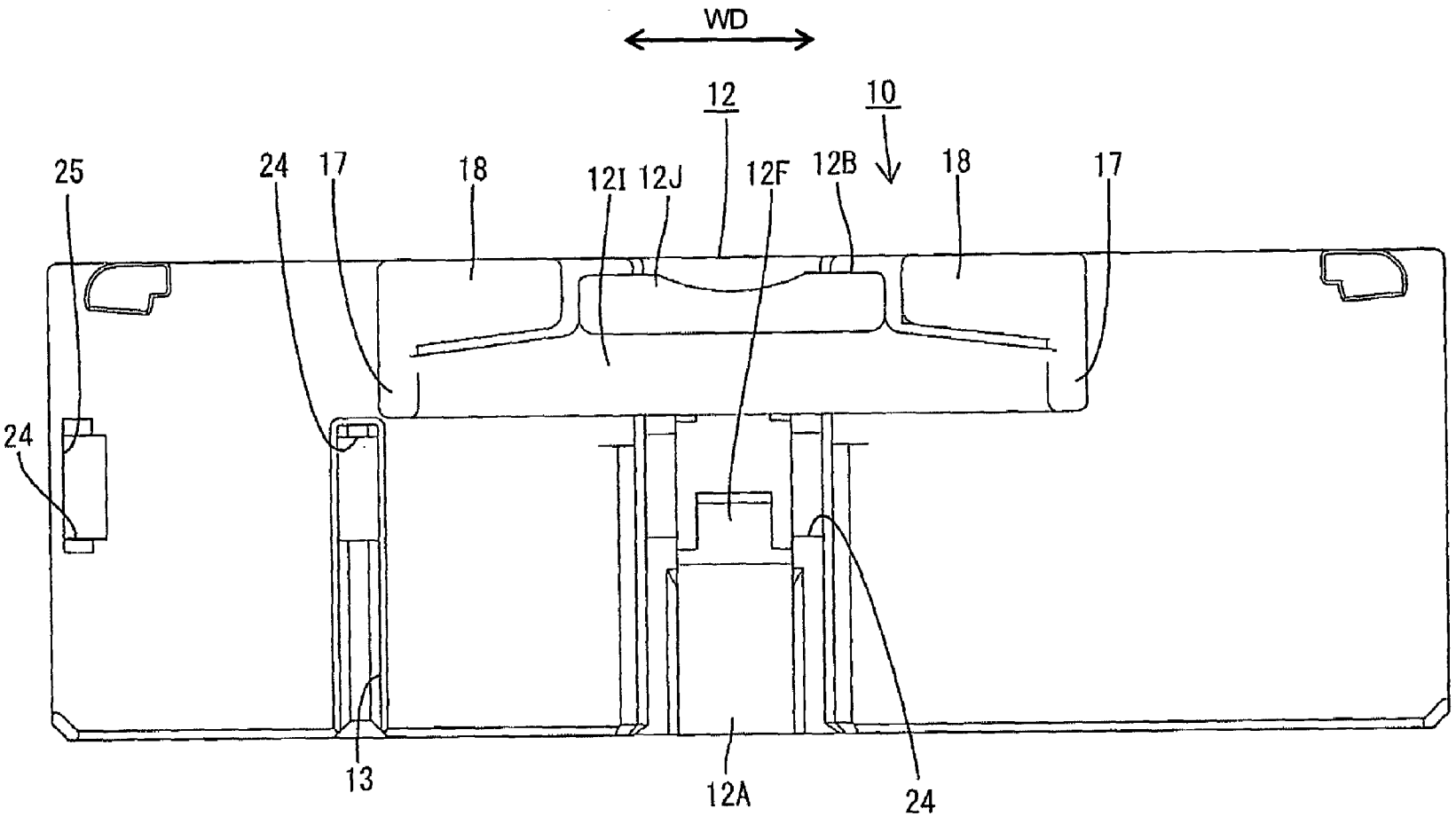
FIG. 3 is plan view of the housing.

As shown in FIG. 3, a forwardly open guide groove 13 is formed in each cavity eliminated portion 11X and receives ribs of an unillustrated male housing to prevent a forcible connection.

Figure 13A:
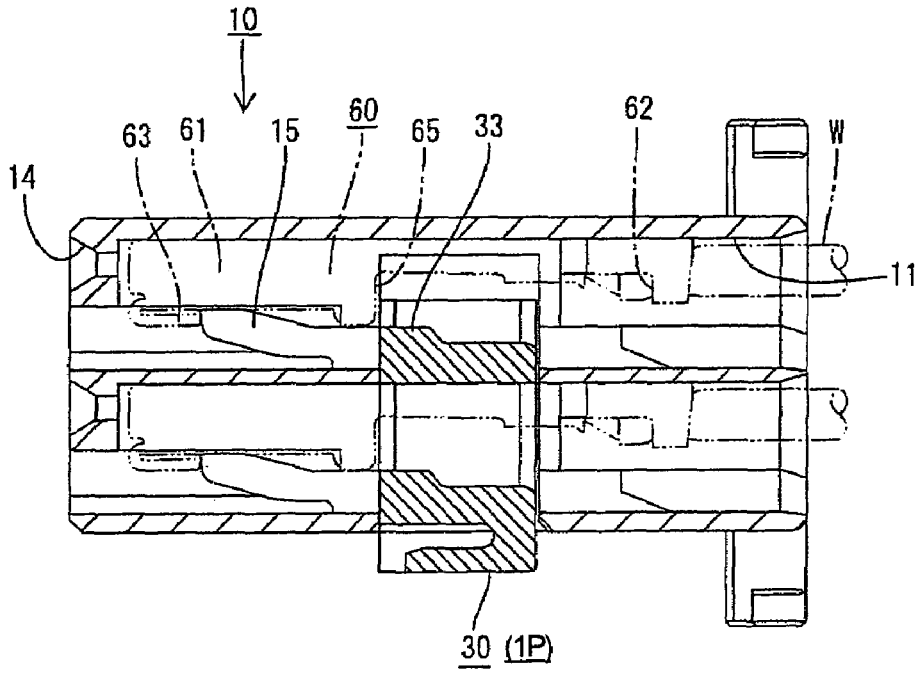
FIGS. 13(A) and 13(B) are sections along 13—13 of FIG. 2 showing the state where the retainer is at the partial locking position and the state where the retainer is at the full locking position.
Figure 13B:
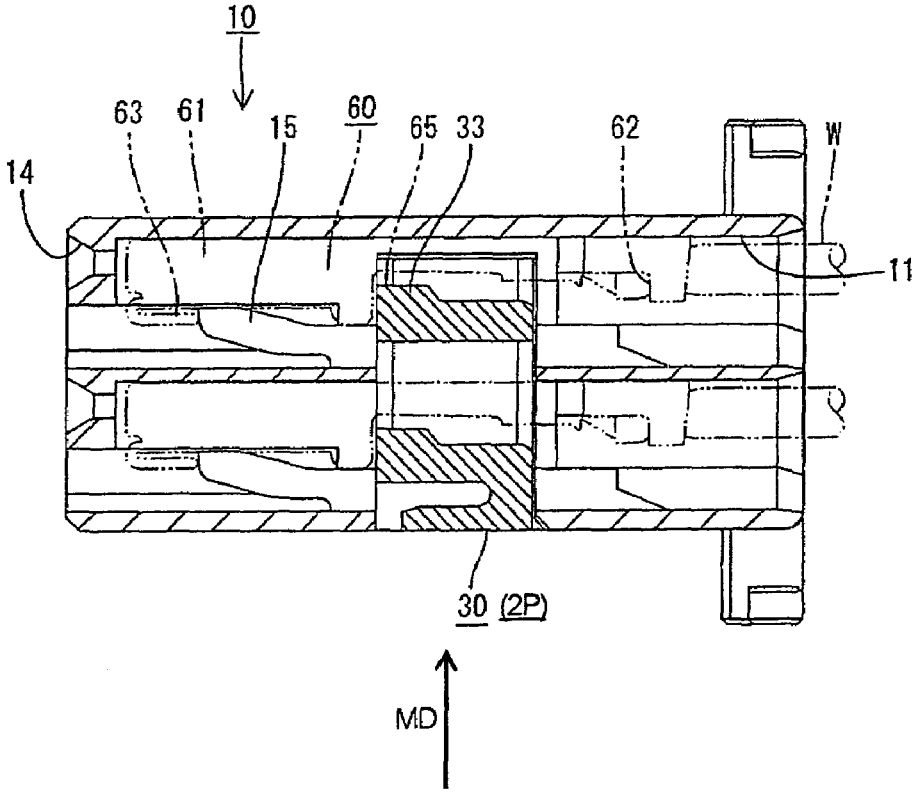
Figure 14:
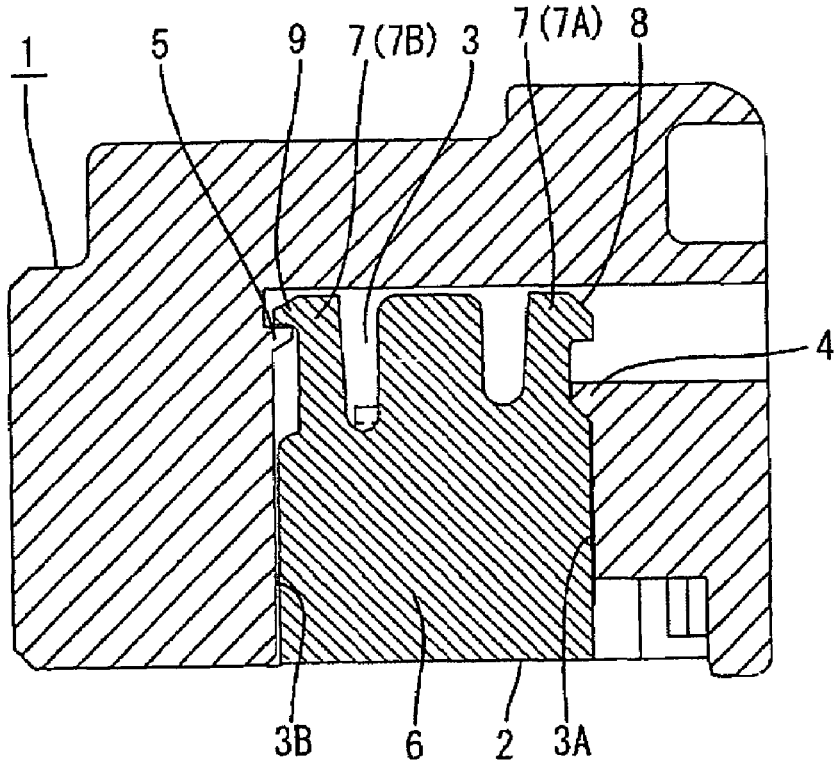
FIG. 14 PRIOR ART
FIG. 14 is a side view in section of a prior art connector when a retainer is at a full locking position.

The connector further includes terminal fittings. As shown in FIGS. 13(A) and 13(B), each female terminal fitting 60 has a rectangular tubular main portion 61 and a barrel 62 behind the main portion 61. The main portion 61 is configured for connection with a mating male terminal fitting, and the barrel 62 is configured for crimped, bent or folded connection with an end of a wire W. A tab insertion opening 14 is formed in the front wall of each cavity 11 for receiving an unillustrated male terminal fitting. A resiliently deformable lock 15 is cantilevered up and forwardly from the bottom wall of each cavity 11. The female terminal fitting 60 is inserted forwardly into the cavity 11 along an inserting direction ID and pushes the lock 15. As a result, the lock 15 deforms in a direction intersecting the inserting direction ID. The lock 15 is restored resiliently to engage a locking projection 63 on the main portion 61 when the female terminal fitting 60 reaches a proper position.

A recess 16 is formed in forward and backward directions FBD over substantially the entire length in a substantially widthwise middle part of the upper surface of the housing 10, and the lock arm 12 is formed in the recess 16. The lock arm 12 has a main body 12A that extends in forward and backward directions FBD, and an unlocking portion 12B bulges out in the width direction at the rear end of the main body 12A.

Figure 6:
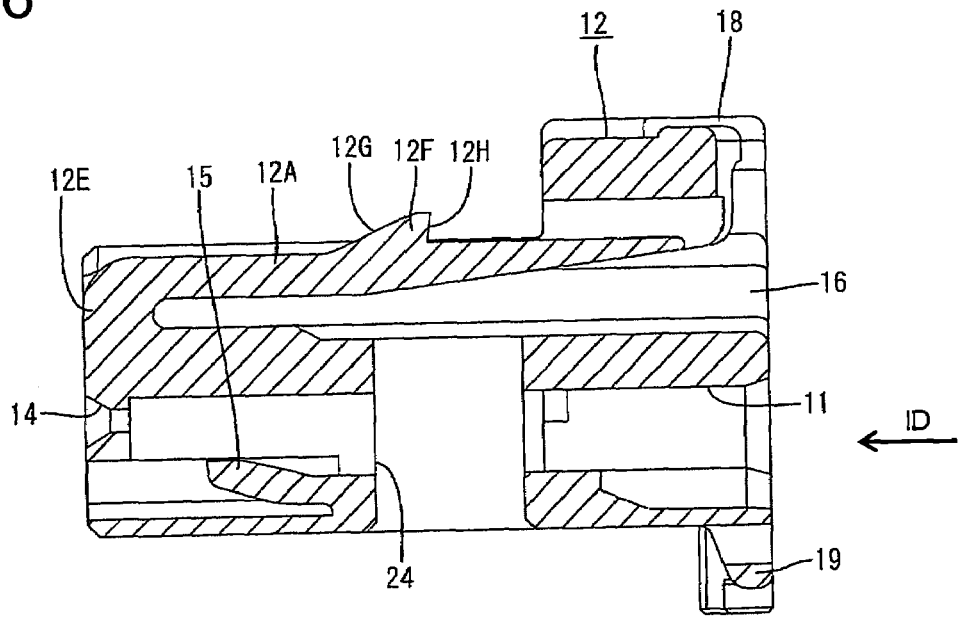
FIG. 6 is a section along 6—6 of FIG. 2.
Figure 7:
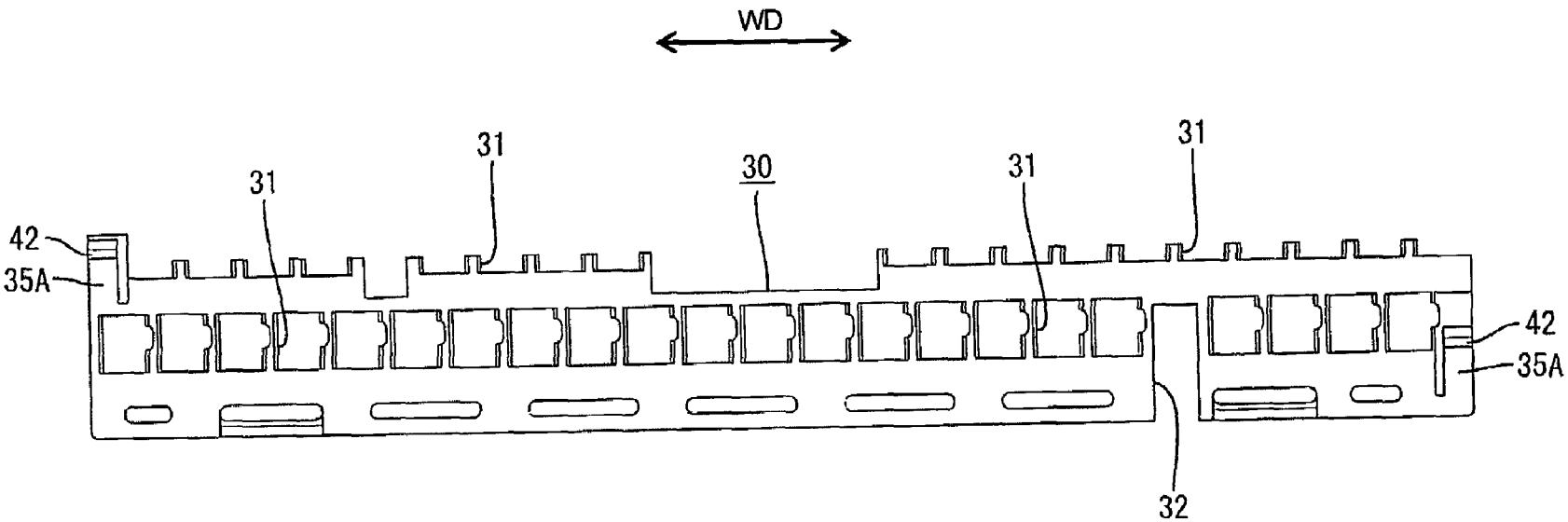
FIG. 7 is a front view of a retainer.
Figure 8:
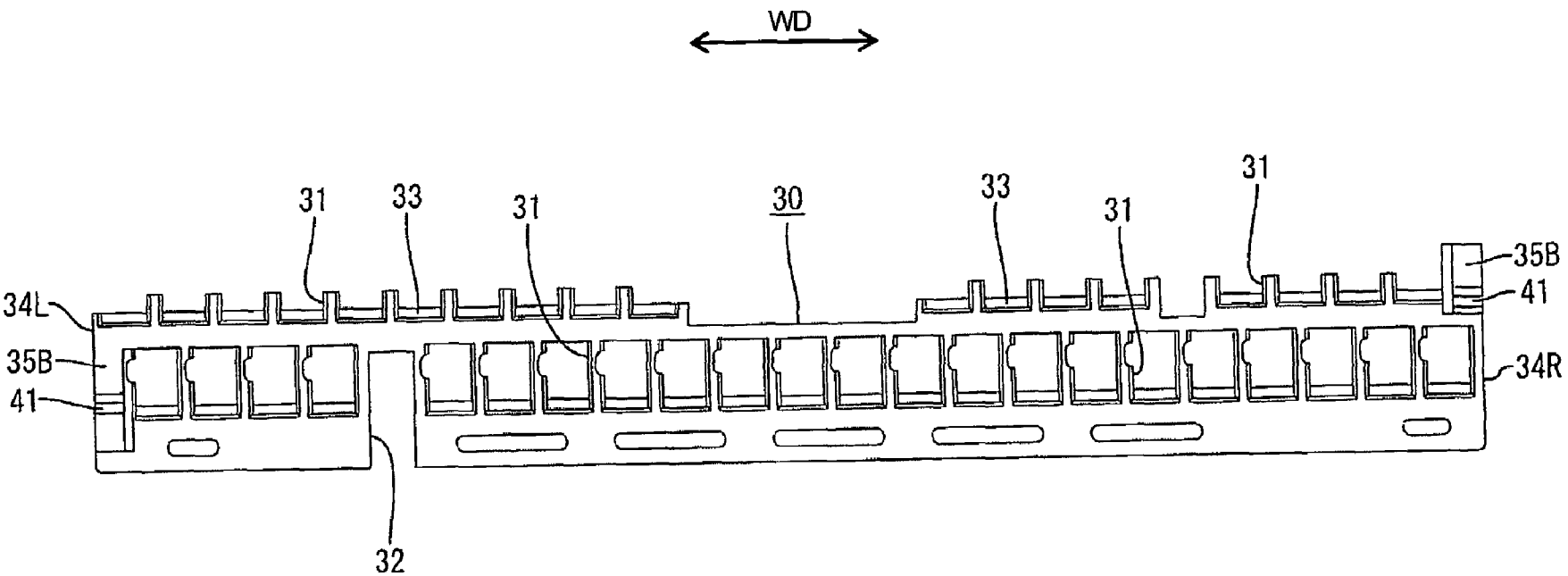
FIG. 8 is a rear view of the retainer.

The lock arm 12 has a support 12E that projects up from the bottom of the recess 16 at the front of the housing 10 and the main body 12A extends back from the support 12E to a position near the rear end of the housing 10, as shown in FIG. 6. The main body 12A is resiliently displaceable up and down towards and away the housing 10 relative to the support 12E. A lock projection 12F is provided at substantially the longitudinal center of the upper surface of the main body 12A and is engageable with an engaging portion in the unillustrated male housing. The lock projection 12F has a guiding surface 12G that slopes up and back and a rear locking surface 12H that extends up and slightly back.

Figure 1:
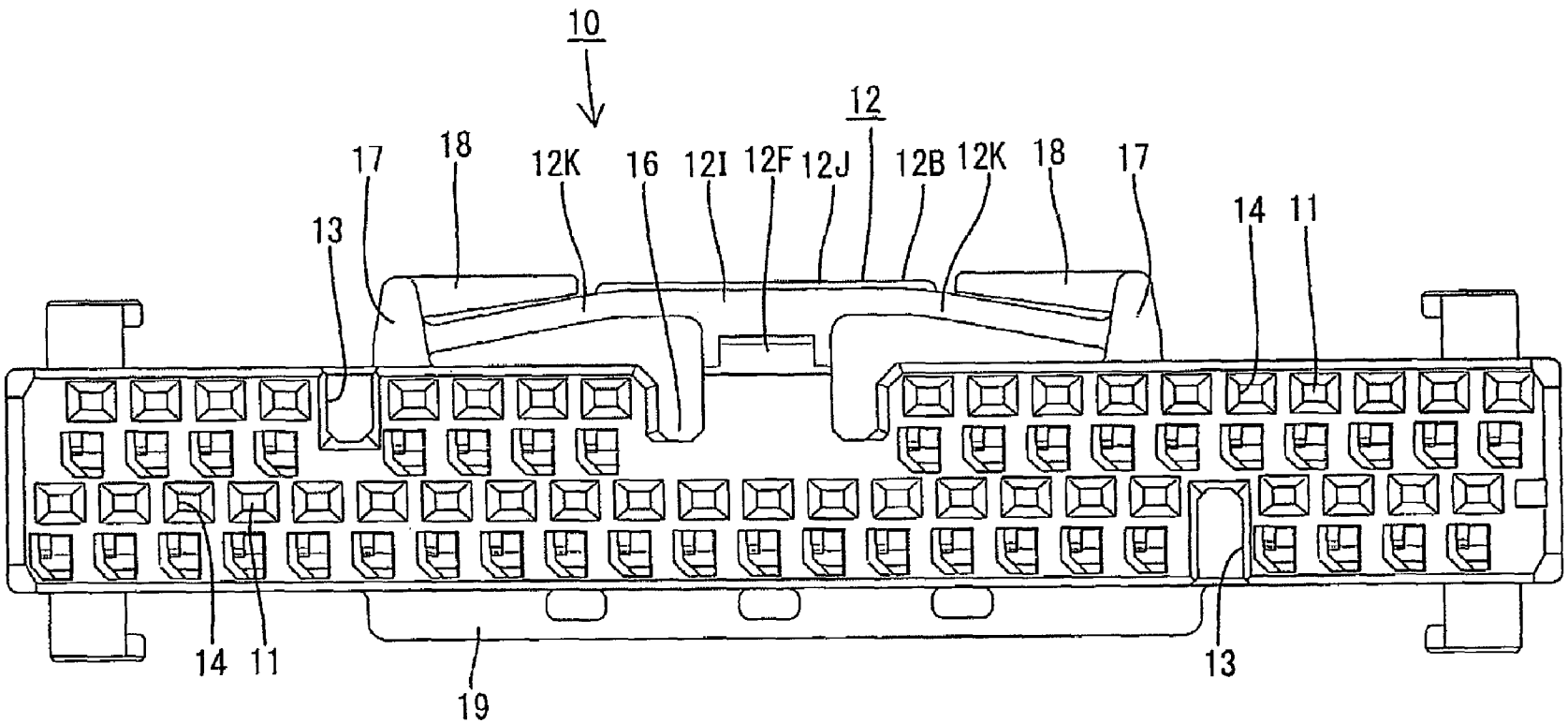
FIG. 1 is front view of a housing according to one embodiment of the invention.
Figure 2:
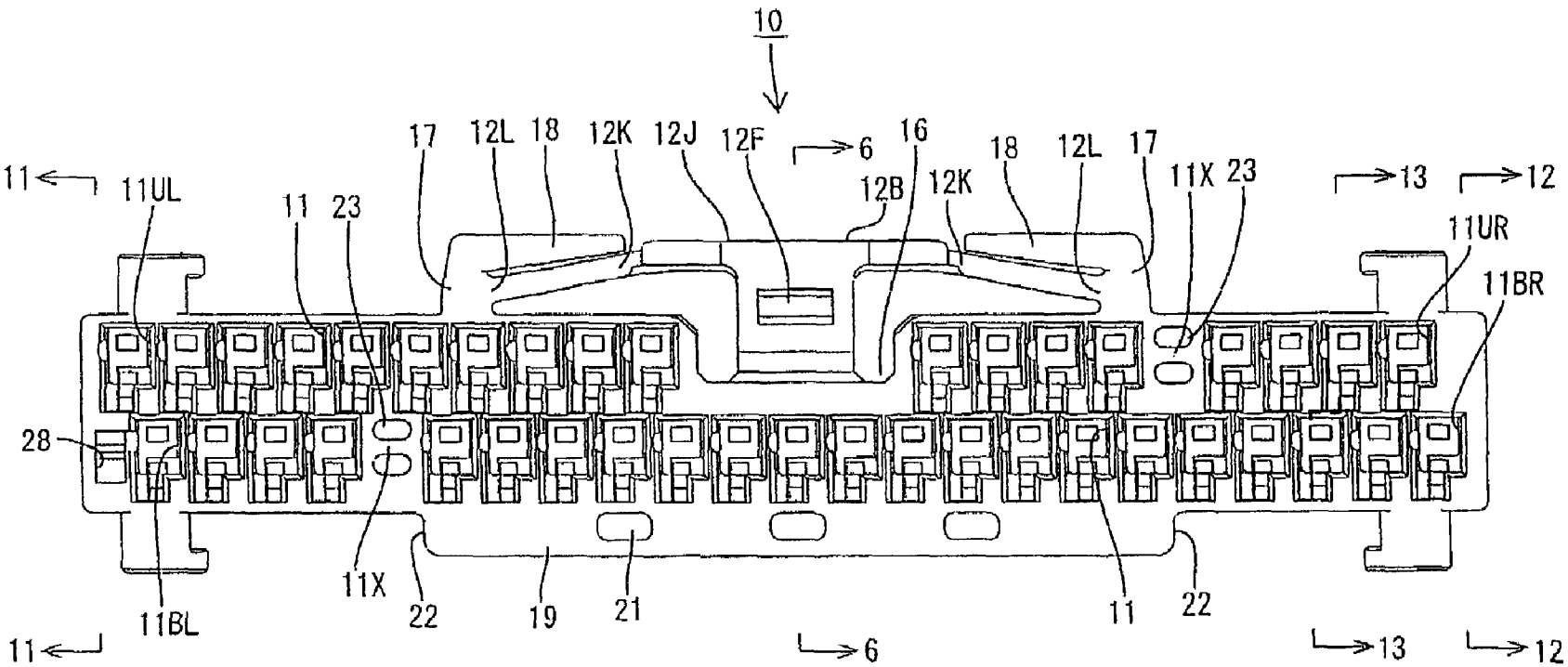
FIG. 2 is a rear view of the housing.

As shown in FIGS. 1 to 3, the unlocking portion 12B extends unitarily from the upper surface of the main body 12A of the lock arm 12 at a position near the rear end of the main body 12A. Additionally, the unlocking portion 12B is aligned at substantially right angles to the main body 12A. Specifically, a pressing portion 12I is defined at the widthwise middle of the unlocking portion 12B and an elevated portion 12J extends up from the pressing portion 12I. Left and right arms 12K project from the left and right edges of the pressing portion 12I before the elevated portion 12J.

Left and right protection walls 17 stand up at the opposite sides of the unlocking portion 12B on the upper surface of the housing 10. The protection walls 17 extend the front of the unlocking portion 12B to the rear of the housing 10, and the upper ends of the protection walls are slightly higher than the elevated portion 12J of the unlocking portion 12B.

The left and right arms 12K of the unlocking portion 12B slope down towards the respective left and right protection walls 17 and are coupled to the front bottom positions of the facing inner surfaces of the protection walls 17 at couplings 12L. Thus, the unlocking portion 12B is arch-shaped (see e.g. FIG. 1) and is resiliently displaceable up and down towards and away from the housing 10 with couplings 12L of the arms 12K to the protection walls 17 as supports. Thus, the entire lock arm 12 is supported at three points.

Two restricting walls 18 are formed at the upper ends of the rear sides of the protection walls 17 and extend towards each other (see e.g. FIG. 1). Upper surfaces of the restricting walls 18 are substantially horizontal and are higher than the base ends of the arms 12K, whereas the lower surfaces of the restricting walls 18 slope down towards the base ends thereof to gradually increasing the thickness. The restricting walls 18 are above the arms 12K, but spaced back from the arms 12K. The arms 12K and the restricting walls 18 are separated along forward and backward directions FBD to ensure simpler dies.

A thick finger placing wall 19 projects in a widthwise middle of the rear end of the bottom surface of the housing 10, which is the surface of the housing 10 opposite the surface where the lock arm 12 is formed. The finger placing wall 17 is slightly wider than the spacing between the protection walls 17 and preferably is about half the height of the protection walls 17. The finger placing wall 19 can be gripped by an operator for connecting and separating the housing 10 with and from the unillustrated male housing.

Various marks are formed on the rear surface of the housing 10 to enable the operator to visually confirm the position of the cavities 11. First marks 21 in the form of through holes penetrate the finger placing wall 19 in forward and backward directions FBD. The marks 21 are substantially rectangular holes with substantially straight left and right vertical edges. When viewed from behind, the left edges of the respective marks 21 align with the left edges of the entrances of specific cavities 11 at the upper stage, and the right edges align with the right edges of the entrances of specific cavities 11 at the lower stage. Left and right edges of the finger placing wall 19 are substantially straight and function as second marks 22. The left mark 22 substantially aligns with the left edge of the entrance of a specific cavity 11 at the upper stage, whereas the right mark 22 substantially aligns with the right edge of the entrance of a specific cavity 11 at the lower stage. Third marks 23 are formed in the rear surfaces of the cavity eliminated portions 11X by recessing.

Figure 4:
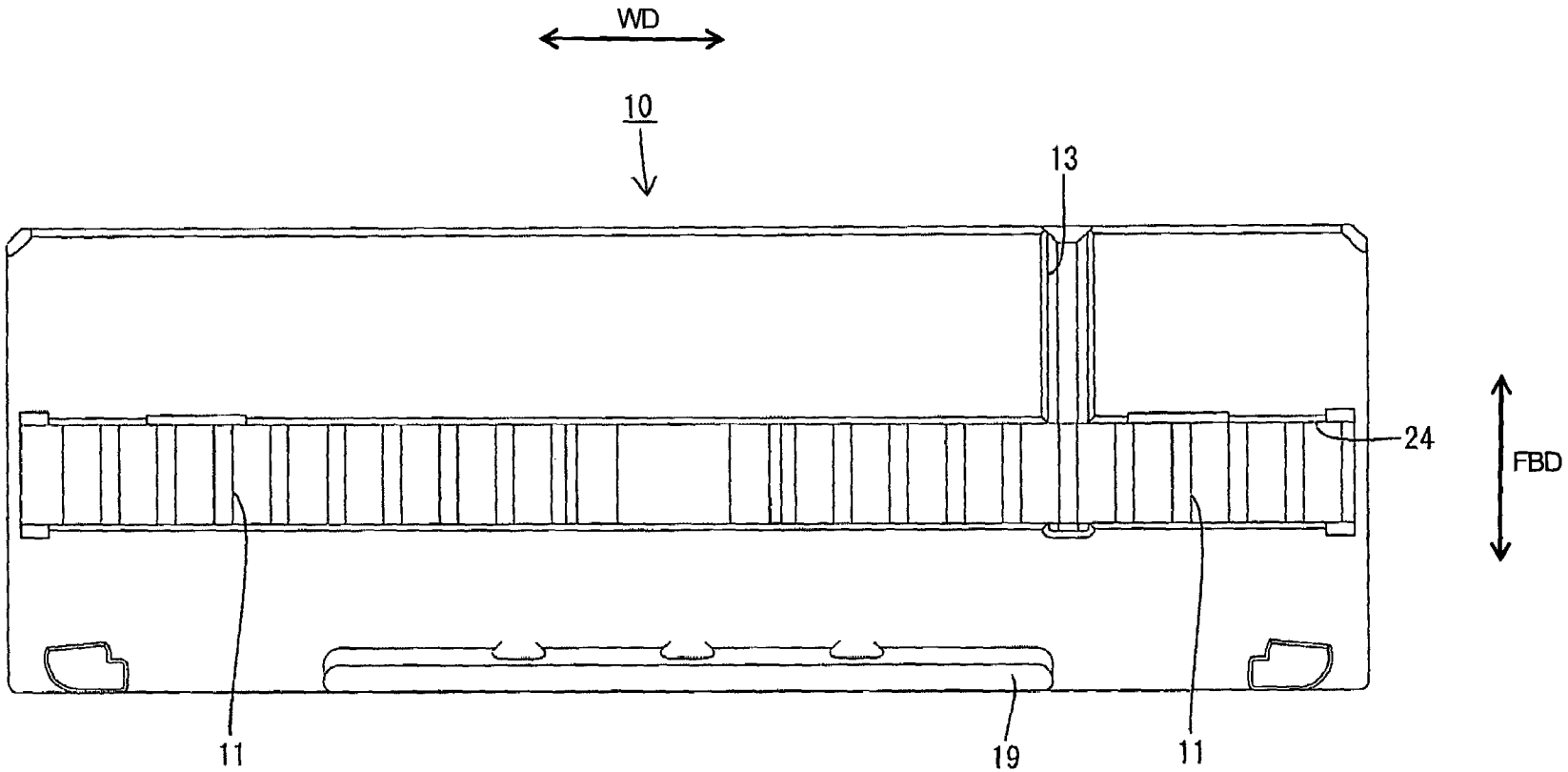
FIG. 4 is a bottom view of the housing.
Figure 5:
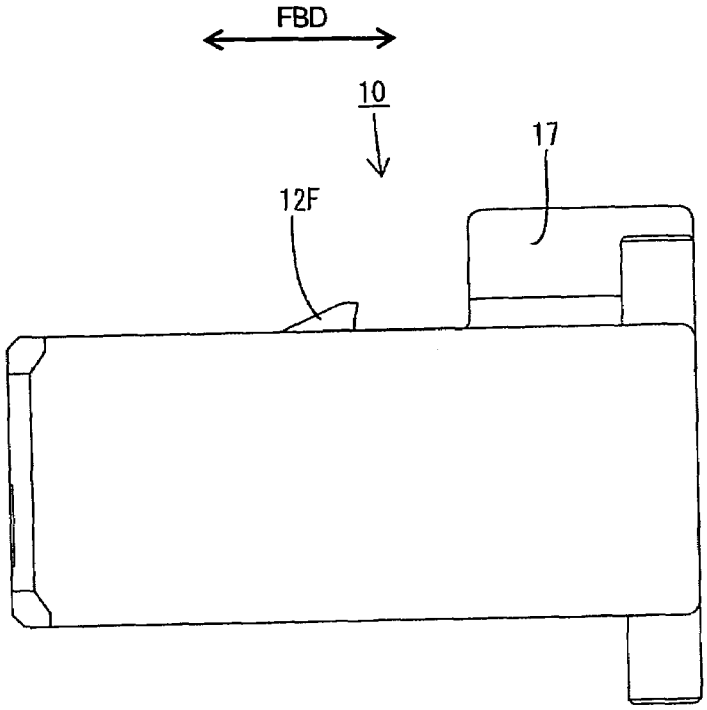
FIG. 5 is a side view of the housing.

As shown in FIG. 4, a retainer mount hole 24 is formed substantially in the middle of the bottom surface of the housing 10 with respect to the forward and backward directions FBD. The retainer mount hole 24 has a wide rectangular shape when viewed from below and crosses all the cavities 11 while leaving the left and right side walls of the housing 10. Additionally, the retainer mount hole 24 communicates with the recess 16, the guide grooves 13, and a window hole 25 formed at the left edge shown in FIG. 3.

Figure 11A:
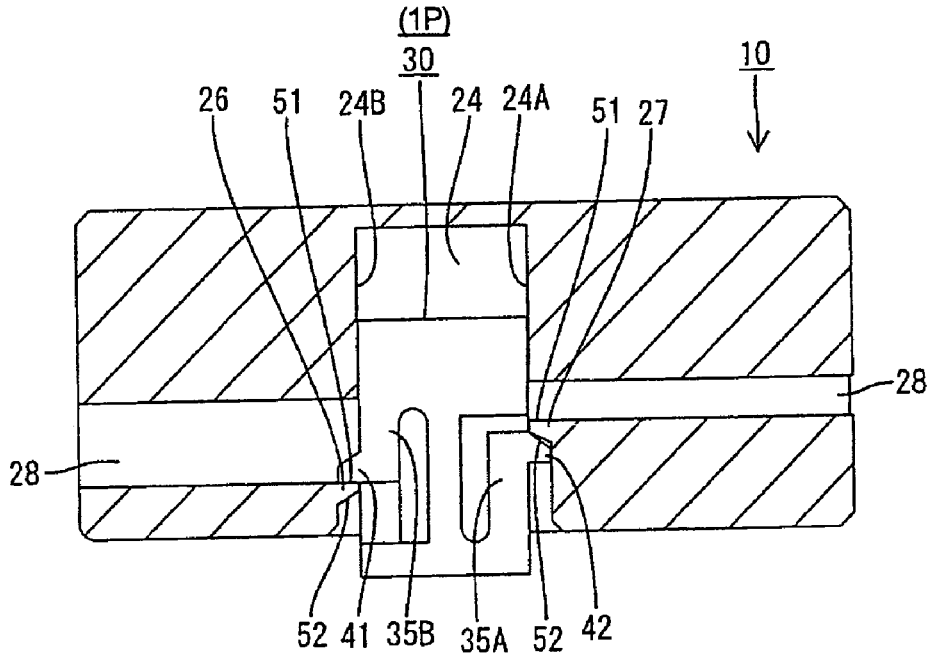
FIGS. 11(A) and 11(B) are sections along 11—11 of FIG. 2 showing a state where the retainer is at a partial locking position and a state where the retainer is at a full locking position, respectively.
Figure 11B:
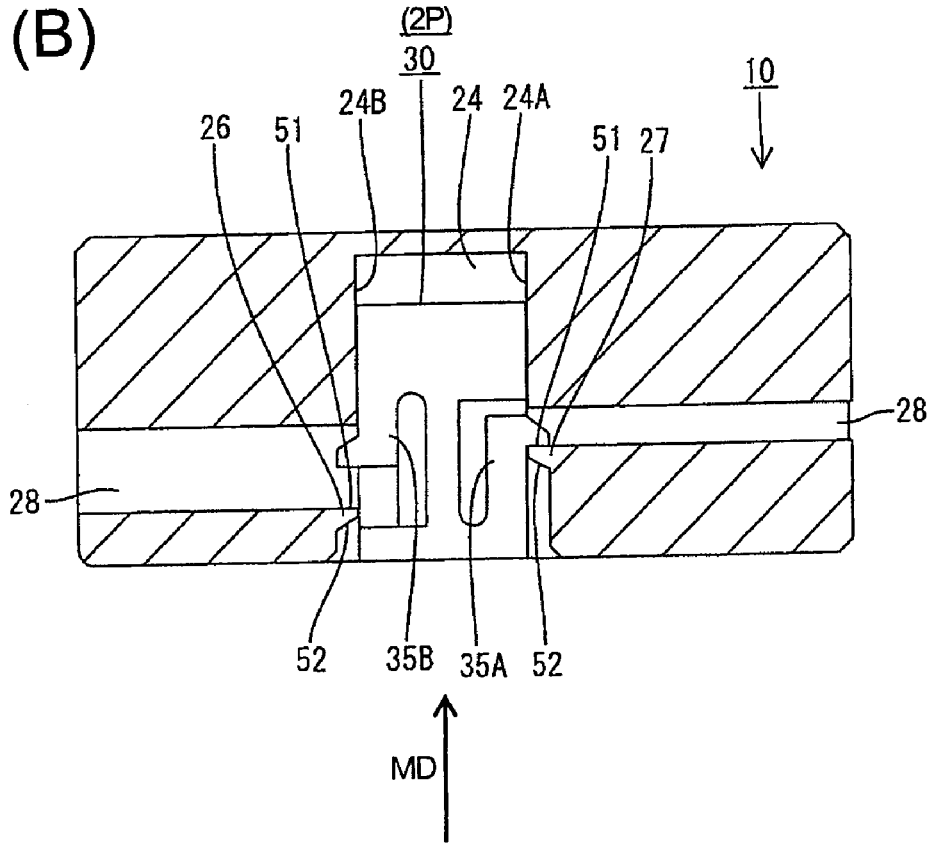
Figure 12A:
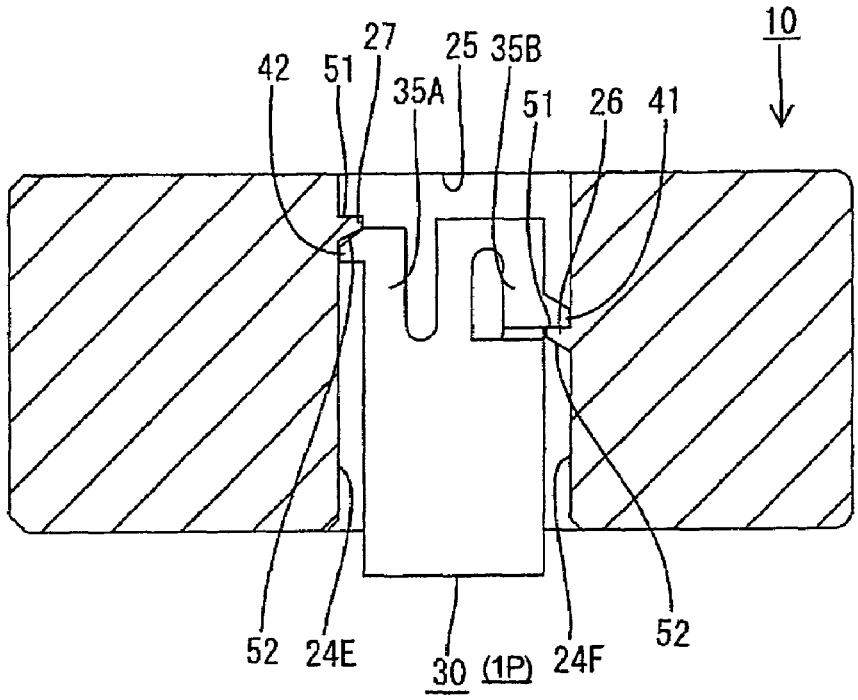
FIGS. 12(A) and 12(B) are sections along 12—12 of FIG. 2 showing the state where the retainer is at the partial locking position and the state where the retainer is at the full locking position, respectively.
Figure 12B:
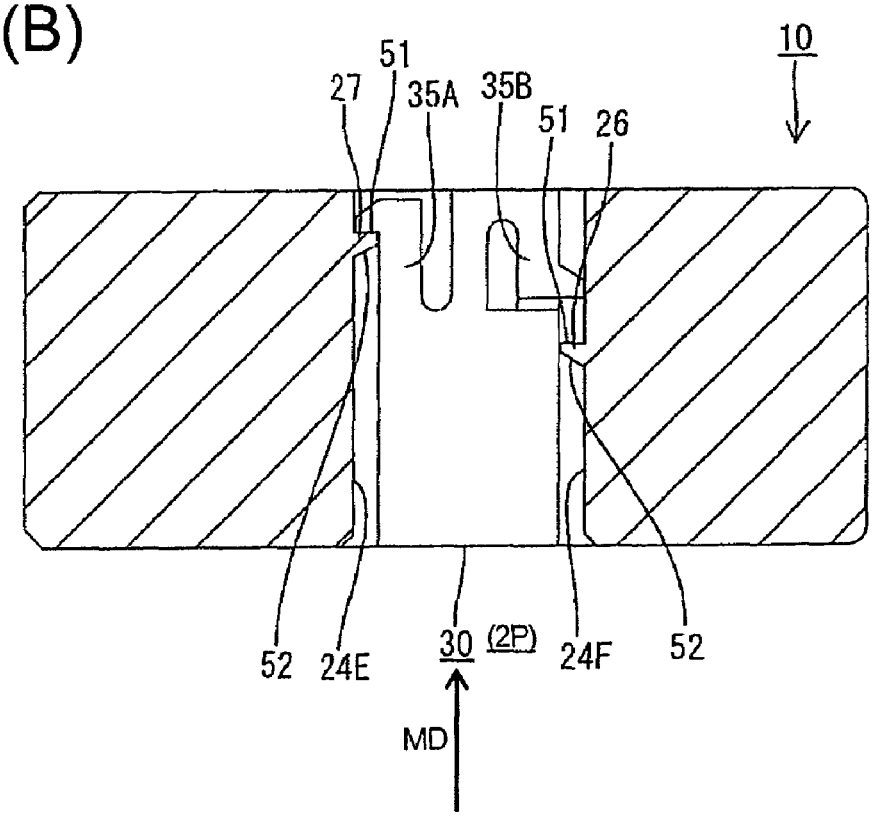

The retainer mount hole 24 has substantially parallel front and rear walls that face each other along forward and backward directions FBD. More particularly, FIGS. 11(A) and 11(B) show the front and rear walls 24A, 24B at the left side when viewed from behind, and FIGS. 12(A) and 12(B) show the front and rear walls 24E, 24F at the right side when viewed from behind. Receiving portions 26 for partial locking project in from the rear walls 24B, 24F and receiving portions 27 for full locking project in from the front walls 24A, 24E at the opposite sides of the housing 10. The receiving portions 27, 26 on the front and rear walls 24A, 24B at the left, as shown in FIGS. 11(A) and 11(B), are below the left-most upper stage cavity 11UL and at the left of the left-most lower stage cavity 11BL. The receiving portions 27, 26 on the front and rear walls 24E, 24F at the right, as shown in FIGS. 12(A) and 12(B), are at the right side of the right-most upper stage cavity 11UR and above the right-most lower stage cavity 11BR. Thus, the receiving portions 26, 27 are formed in dead spaces that are offset with respect to the vertical direction VD and the width direction WD to avoid interference with the cavities 11.

As shown in FIG. 12(A), the front and rear walls 24E, 24F at the right side when viewed from behind are formed so that the retainer mount hole 24 penetrates the housing 10 vertically and communicates with the window 25. Additionally, the receiving portions 26, 27 for partial and full locking are at upper sides of the front and rear walls 24E, 24F. More specifically, the receiving portion 26 for partial locking is on the rear wall 24F and the receiving portion 27 for full locking is on the front wall 24E at a position higher along the vertical direction VD than the receiving portion 26 for partial locking. On the other hand, as shown in FIG. 11(A), the front and rear walls 24A, 24B at the left end when viewed from behind are formed so that the retainer mount hole 24 extends substantially vertically in the housing 10, but has the upper end thereof closed by the upper wall of the housing 10. The receiving portions 26, 27 for partial and full locking are formed at lower sides of the front and rear walls 24A, 24B. More specifically, the receiving portion 26 for partial locking is on the rear wall 24B and the receiving portion 27 for full locking is on the front wall 24A at a position higher than the receiving portion 26 for partial locking. Each receiving portion 26, 27 has a horizontally aligned upper locking surface 51 and an upwardly sloped lower guiding surface 52. The locking surfaces 51 of the receiving portions 26, 27 at the left side, as shown in FIGS. 11(A) and 11(B), are substantially continuous and flush with mold removal holes 28 that penetrate the housing 10 along forward and backward directions FBD to form the locking surfaces 51.

The connector further includes a side-type retainer 30 in the form of a wide lattice, as shown in FIGS. 7 to 10. The retainer 30 can be fit lightly into the retainer mount hole 24 of the housing 10 and can be held at a partial locking position 1P, as shown in FIG. 13(A). The retainer 30 at the partial locking position 1P projects slightly from the bottom surface of the housing 10. The female terminal fittings 60 can be inserted into the cavities 11 and withdrawn from the cavities 11 when the retainer 30 is at the partial locking position 1P. The retainer 30 can be pushed in the mounting direction MD from the partial locking position 1P to a full locking position 2P, as shown in FIG. 13(B). The bottom surface of the retainer 30 is substantially flush with the bottom surface of the housing 10 when the retainer 30 reaches the full locking position 2P. The retainer 30 has a row of cavity portions 31 that correspond to the lower stage cavities 11 when the retainer 30 is at the full locking position 2P. A notch with an open bottom is formed at a position on the retainer 30 corresponding to the cavity eliminated portion 11X. A row of cavity portions 31 is formed along the top of the retainer 30 and form lower halves of the upper stage cavities 11 when the retainer 30 is at the full locking position 2P. Retaining portions 33 are formed at the front portions of the bottom walls of the cavity portions 31 and project higher than the rear portions of the bottom walls. The retaining portions 33 engage the jaws 65 of the main portions 61 of the female terminal fittings 60 when the retainer 30 is at the full locking position 2P. Thus, the female terminal fittings 60 are locked doubly in the cavities 11 by the locks 15 and the retaining portions 33 when the retainer 30 is in the full locking position 2P.

Holding portions 34R, 34L are formed at the opposite widthwise ends of the retainer 30 for holding the retainer 30 at the partial locking position 1P and the full locking position 2P.

Figure 9:
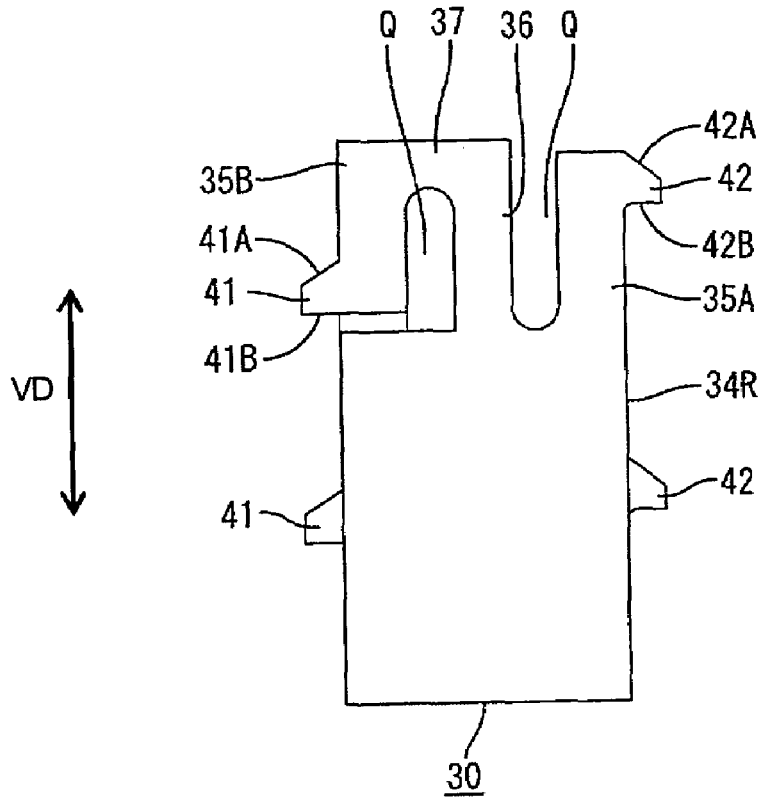
FIG. 9 is a left side view of the retainer of FIG. 8.

As shown in FIG. 9, the holding portion 34R at the right end when viewed from behind is sufficiently high to be located in the window hole 25 in the upper surface of the housing 10 when the retainer 30 is at the full locking position 2P. Front and rear cantilevered holding arms 35A, 35B are formed at an upper side of the holding portion 34R. The free ends of the cantilevered holding arms 35A, 35B are resiliently displaceable substantially in forward and backward directions FBD, and substantially normal to the moving direction MD. The holding arm 35A (right side in FIG. 9) holds the retainer 30 at the full locking position 2P, whereas the holding arm 35B holds the retainer 30 at the partial locking position 1P.

The holding arms 35A, 35B of the holding portion 34R extend in different directions from the supported ends to the free ends. More specifically, the holding arm 35A for full locking extends up from the supported end to the free end, whereas the holding arm 35B for partial locking extends down from the supported end to the free end. The holding portion 34R has a supporting arm 36 arranged substantially parallel with the holding arms 35A, 35B while defining deformation spaces Q thereto. The bottom end of the supporting arm 36 is coupled unitarily to the bottom end of the holding arm 35A for full locking while the upper end thereof is coupled unitarily to the upper end of the holding arm 35B for partial locking. Thus, the holding arms 35A, 35B and the supporting arm 36 have a substantially reversed S-shape (see FIGS. 9 to 11) and the holding arms 35A, 35B are substantially point-symmetric with respect to an imaginary axis extending in widthwise direction WD through the supporting arm 36. A coupling 37 couples the supporting arm 36 and the holding arm 35B for partial locking and forms the upper surface of the holding portion 34R at the right end, and is exposed at the outer surface of the housing 10 through the window 25.

Figure 10:
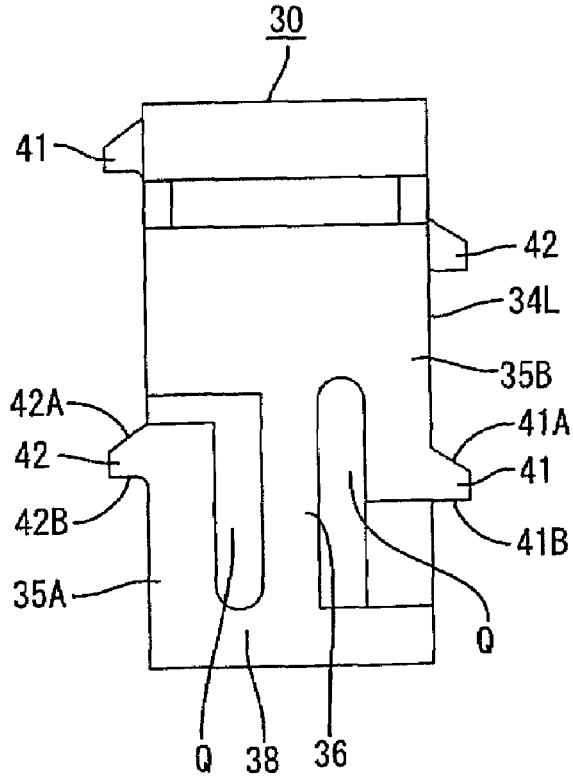
FIG. 10 is a right side view of the retainer of FIG. 8.

As shown in FIG. 10, front and rear cantilevered holding arms 35A, 35B are formed at a lower side of the holding portion 34L at the left end when viewed from behind. The holding arm 35A at the front side (left side in FIG. 10) is for full locking and holds the retainer 30 at the full locking position 2P. The holding arm 35B at the rear side is for partial locking and holds the retainer 30 at the partial locking position 1P. The holding arm 35A for full locking extends up substantially along the mounting direction MD from the supported end to the free end, whereas the holding arm 35B for partial locking extends down from the supported end to the free end. A supporting arm 36 is substantially parallel to the holding arms 35A, 35B while defining deformation spaces Q thereto. The upper end of the supporting arm 36 is coupled unitarily to the upper end of the holding arm 35B for partial locking while the bottom end thereof is coupled unitarily to the bottom end of the holding arm 35A for full locking (see e.g. FIG. 10). A coupling portion 38 couples the supporting arm 36 and the holding arm 35A for full locking to form the lower surface of the holding portion 34L and to close the retainer mount hole 24.

The holding arms 35A, 35B are arranged separately at the left and right sides of the housing 10. The holding arms 35A for full locking extend up in the mounting direction MD from the supported ends to the free ends to correspond to the receiving portions 27 for full locking at higher positions. However, the holding arms 35B for partial locking extend down from the supported ends to the free ends to correspond to the receiving portions 26 for partial locking at lower positions. In this respect, the retainer 30 has a common structure at the left and right ends of the housing 10.

A locking section 41 for partial locking is formed at the free end of each holding arm 35B for partial locking and projects out for engaging the corresponding receiving portion 26 for partial locking. The locking section 41 is shaped to increase the thickness gradually towards the free end of the holding arm 35B, and has a slanted movement guiding surface 41A for guiding a movement of the receiving portion 26 for partial locking onto the locking section 41 by sliding in contact with the guiding surface 52 of the receiving portion 26 in the process of moving the retainer 30 to the partial locking position. A horizontal locking surface 41B is formed at the lower face of the locking section 41 and is closely engageable with the locking surface 51 of the corresponding receiving portion 26 at the partial locking position.

A locking section 42 for full locking is formed at the free end of each holding arm 35A for full locking and projects out for engaging the corresponding receiving portion 27 for full locking. The locking section 42 is shaped to decrease the thickness gradually towards the free end of the holding arm 35A. Thus, a slanted movement guiding surface 42A is defined on the locking section for guiding the receiving portion 27 for full locking onto the locking section 42 by sliding in contact with the guiding surface 52 of the receiving portion 27 in the process of moving the retainer 30 in the mounting direction MD from the partial locking position 1P to the full locking position 2P. A substantially horizontal locking surface 42B is defined on the lower surface of the locking section 42 and is closely engageable with the locking surface 51 of the corresponding receiving portion 27 at the full locking position 2P.

The retainer 30 is inserted from below and along the mounting direction MD into the retainer mount hole 24 in the bottom surface of the housing 10. In the process of inserting the retainer 30, the movement guiding surfaces 41A of the locking sections 41 slide in contact with the guiding surfaces 52 of the receiving portions 26 for partial locking to deform the holding arms 35B for partial locking resiliently inward. The holding arms 35 for partial locking are restored resiliently when the retainer 30 reaches the partial locking position 1P. Thus, the locking surfaces 41B of the locking sections 41 contact the locking surfaces 51 of the receiving portions 26 for partial locking for locking the retainer 30 at the partial locking position 1P. Additionally, the holding arms 35A for full locking are arranged so that the movement guiding surfaces 42A of the locking sections 42 contact the guiding surfaces 52 of the receiving portions 27 for full locking from below.

The female terminal fittings 60 can be inserted into the cavities 11 when the retainer 30 is at the partial locking position 1P because the retaining portions 33 of the retainer 33 are retracted from the cavities 11, as shown in FIG. 13(A). The female terminal fittings 60 are not inserted into all the cavities 11 and the cavities 11 into which the female terminal fitting 60 should be inserted is decided before hand. Thus, the operator inserts the female terminal fittings 60 while referring to a work sheet showing the addresses of the cavities 11. In this case, the various marks 21, 22, 23 are formed on the rear surface of the housing 10 and the addresses of the cavities 11 are easy to confirm visually by counting from the specified marks 21, 22, 23. Thus, the female terminal fittings 60 can be inserted into the corresponding cavities 11 without error. The locks 15 lock the female terminal fitting 60 that have been inserted into the cavity 11 to a proper depth.

The retainer 30 then is inserted deeper in the mounting direction MD into the retainer mount hole 24 to reach the full locking position 2P. The movement guiding surfaces 42A of the locking sections 42 slide in contact with the guiding surfaces 52 of the receiving portions 27 for full locking in the process of moving the retainer 30 from the partial locking position 1P to the full locking position 2P to deform the holding arms 35A for full locking resiliently inward. The holding arms 35A for full locking return resiliently when the retainer 30 reaches the full locking position 2P to bring the locking surfaces 42B, 51 of the locking sections 42 and the locking surfaces 51 of the receiving portions 27 for full locking into contact as shown in FIGS. 11(A) and 11(B), thereby locking the retainer 30. In this case, the locking sections 41, 42 of the holding arms 35A, 35B for partial locking and full locking at the holding portion 34L at the left end when viewed from behind are in the mold removal holes 28 and the upper end of the holding portion 34L is fit closely in an upper part of the retainer mount hole 24 leaving almost no clearance. When the retainer 30 reaches the full locking position 2P in this way, the retaining portions 33 of the retainer 30 are located behind the jaws 65 of the main portions 61 of the female terminal fittings 60 as shown in FIG. 13(B). As a result the respective female terminal fittings 60 are locked doubly. Thereafter, the housing 10 is connected with the unillustrated male housing. The lock arm 12 locks the housings together when the housings are connected to a proper depth. At this time, the corresponding male and female terminal fittings are properly connected to establish electrical connections.

As described above, the receiving portions 27 for full locking are above the receiving portions 26 for partial locking, i.e. located before the receiving portions 26 with respect to an inserting direction MD of the retainer 30. Additionally, the holding arms 35A for full locking extend up in the inserting direction MD of the retainer 30 from the supported ends to the free ends and the holding arms 35B for partial locking extend down in a direction opposite from the inserting direction MD of the retainer 30 from the supported ends to the free ends. Accordingly, as compared to a case where the holding arms 35A, 35B for partial locking and full locking extend in the same direction from the supported ends at the substantially same height, a sufficient length can be ensured for the holding arms 35B for partial locking, and smooth resilient deformations of the holding arms 35A, 35B is ensured.

The movement guiding surfaces 41A, 42A of the locking sections 41, 42 of the holding arms 35A, 35B for partial locking and full locking slide in contact with the guiding surfaces 52 of the corresponding receiving portions 26, 27 to ensure smooth resilient deformations of the holding arms 35A, 35B.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Contrary to the foregoing embodiment, the holding arms for partial locking may extend in the inserting direction MD of the retainer from the supported ends to the free ends and the holding arms for full locking may extend in the direction opposite from the inserting direction MD of the retainer from the supported ends to the free ends by arranging the receiving portions for partial locking before the receiving portions for full locking with respect to the mounting direction of the retainer on the walls of the retainer mount hole according to the present invention.

The invention is similarly applicable to connectors in which a retainer is provided in a male connector having male terminal fittings therein.

The terminal fitting is locked doubly in the cavity by the retainer and the locking portion. However, the terminal fitting may be locked in the cavity only by the retainer.

What is claimed is:

1. A connector, comprising:

a housing formed with at least one cavity for receiving a terminal fitting, a retainer mount hole formed in an outer wall of the housing and crossing the cavity, receiving portions being formed in the housing on facing inner wall surfaces of the retainer mount hole; and a retainer mountable in the retainer mount hole and being movable between a first position for permitting the insertion and withdrawal of the terminal fitting and a second position for retaining the terminal fitting in the cavity, first and second resiliently deformable holding arms cantilevered on the retainer, each holding arm having a supported end and a free end, locking sections being formed at the free ends of the holding arms and being resiliently engageable with the corresponding receiving portions at the first position and the second position, wherein one of the receiving portions for first and second positions is arranged before the other with respect to an inserting direction-(MD) of the retainer, the holding arm engageable with the one receiving portion extending in the inserting direction of the retainer from the supported end to the free end while the holding arm engageable with the other receiving portion extending in a direction opposite from the inserting direction of the retainer from the supported end to the free end.

2. The connector of claim 1, wherein the locking sections project towards the corresponding receiving portions.

3. The connector of claim 1, wherein the locking section of the holding arm engageable with the one receiving portion is formed with a movement guiding surface sloped in such a direction as to decrease the thickness toward the free end, and the locking section of the holding arm engageable with the other receiving portion is formed with a movement guiding surface sloped in such a direction as to increase the thickness toward the free end.

4. The connector of claim 1, wherein, when the retainer is positioned in the second position, the locking sections of the holding arms for first and second positions are in mold removal holes and the distal end of a holding portion is fit closely in a corresponding part of the retainer mount hole leaving almost no clearance.

5. The connector of claim 1, wherein a supporting arm is arranged substantially parallel with the holding arms while defining deformation spaces thereto.

6. The connector of claim 5, wherein the holding arms and the supporting arm have a substantially reversed S-shape.

7. The connector of claim 1, wherein the holding arms are arranged substantially point-symmetric with respect to an imaginary axis extending in widthwise direction.

8. The connector of claim 1, wherein the retainer in the second position is substantially flush with the outer surface of the housing.

9. The connector of claim 1, wherein a lock is provided in the cavity for doubly locking the terminal fitting in the cavity in cooperation with the retainer.

10. A connector, comprising:

a housing formed with cavities for receiving terminal fittings, a retainer mount hole formed in an outer wall of the housing and crossing the cavities, at least one receiving portion for partial locking and at least one receiving portion for full locking being formed in the housing on facing inner wall surfaces of the retainer mount hole; and a retainer mountable in the retainer mount hole and being movable between a first position for permitting the insertion and withdrawal of the terminal fittings and a second position for retaining the terminal fittings in the cavity, at least one first resiliently deformable holding arm cantilevered on the retainer and configured for engaging the receiving portion for partial locking and at least one second resiliently deformable holding arm cantilevered on the retainer and configured for engaging the receiving portion for full locking, the first and second holding arms being cantilevered in substantially opposite directions.

11. The connector of claim 10, wherein the retainer is movable in a mounting direction from the first position to the second position, the second locking arm being cantilevered to extend substantially in the mounting direction, the first locking arm being cantilevered to extend substantially opposite to the mounting direction.

* * * * *